US008727530B2

(12) United States Patent
Uchino

(10) Patent No.: US 8,727,530 B2
(45) Date of Patent: May 20, 2014

(54) IMAGE FORMING APPARATUS WITH COVER

(75) Inventor: Yoshinori Uchino, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 60 days.

(21) Appl. No.: 13/351,403

(22) Filed: Jan. 17, 2012

(65) Prior Publication Data

US 2012/0206552 A1 Aug. 16, 2012

(30) Foreign Application Priority Data

Feb. 14, 2011 (JP) ..... 2011-028915

(51) Int. Cl.
*B41J 29/13* (2006.01)

(52) U.S. Cl.
USPC ..... 347/108

(58) Field of Classification Search
None
See application file for complete search history.

(56) References Cited

U.S. PATENT DOCUMENTS

| | | | | |
|---|---|---|---|---|
| 2,311,057 | A | 2/1943 | Lipman et al. | |
| 3,180,572 | A * | 4/1965 | Gallant | 235/1 D |
| 4,330,219 | A | 5/1982 | Miyasaka et al. | |
| 7,300,148 | B2 * | 11/2007 | Elenes | 347/108 |
| 2003/0118390 | A1 | 6/2003 | Yamada et al. | |
| 2006/0283695 | A1 | 12/2006 | Deshimaru | |
| 2007/0138193 | A1 | 6/2007 | Aono et al. | |
| 2009/0110463 | A1 * | 4/2009 | Arrington et al. | 400/693 |
| 2010/0119283 | A1 | 5/2010 | Hosono | |

FOREIGN PATENT DOCUMENTS

| | | |
|---|---|---|
| CN | 1143878 | 2/1997 |
| CN | 1784128 | 6/2006 |
| CN | 101746163 | 6/2010 |
| EP | 2108517 A1 | 10/2009 |
| JP | 11-334175 | 12/1999 |

OTHER PUBLICATIONS

European Search Report dated Jan. 18, 2013 in corresponding European application No. 12 15 4748.3.

* cited by examiner

*Primary Examiner* — Matthew Luu
*Assistant Examiner* — Tracey McMillion
(74) *Attorney, Agent, or Firm* — Cooper & Dunham LLP

(57) ABSTRACT

An image forming apparatus includes a main body, a flexible cover member, and a support member. The main body has a bottom face opposing a surface on which the image forming apparatus rests. The cover member is at least partially flexible, has a bottom opening, and is dimensioned to entirely cover the image forming apparatus except for the bottom face of the image forming apparatus. The support member is pivotably supported on the main body. The support member has base end portions supported on the main body and a front end portion to support a portion of the cover member. With a pivotal movement of the support member, the cover member displaces and deforms and an end of the bottom opening of the cover member moves upward to expose a portion of the image forming apparatus to be accessed by a user operating the image forming apparatus.

8 Claims, 7 Drawing Sheets

IMAGE FORMING APPARATUS WITH COVER

CROSS-REFERENCE TO RELATED APPLICATION

This patent application is based on and claims priority pursuant to 35 U.S.C. §119 to Japanese Patent Application No. 2011-028915, filed on Feb. 14, 2011, in the Japan Patent Office, the entire disclosure of which is hereby incorporated by reference herein.

BACKGROUND

1. Technical Field

This disclosure relates to an image forming apparatus, such as an inkjet recording apparatus, a thermal or other type of information recording apparatus, a copier, a facsimile machine, a printer, a plotter, a word processor, or a multi-functional device having two or more of the foregoing capabilities and a cover used in the image forming apparatus, and more specifically to an image forming apparatus capable of preventing dust from entering, adhering to, or accumulating on the image forming apparatus and a dustproof cover used in the image forming apparatus.

2. Description of the Related Art

Image forming apparatuses are used as printers, facsimile machines, copiers, plotters, or multi-functional devices having two or more of the foregoing capabilities. To prevent dirt or dust from entering its interior or adhering to or accumulating on its exterior surface, a dustproof cover (hereinafter, also simply referred to as "cover") may be employed to entirely cover an image forming apparatus. Typically, such a cover is used during non-operation of the apparatus and removed during operation of the apparatus. However, a cover may be needed during operation, in particular, when such an image forming apparatus is used in a dusty environment. Hence, some conventional dustproof covers are proposed that have an opening and an opening-and-closing unit to open and close the opening so as to enable a user to operate the image forming apparatus, pick up a sheet or recording media, and replace inks with the cover being put on the apparatus.

For example, JP-H11-334175-A proposes a dustproof cover having an opening-and-closing unit to open and close an opening when a user operates or checks a printer or replaces consumables, in order to prevent dust from accumulating on or adhering to the printer regardless of activation or non-activation.

However, in such conventional configurations including that described in JP-H11-334175-A, the opening-and-closing unit as described above is needed to cover the opening of the dustproof cover, thus resulting in a complex configuration of the cover. Additionally, a user must put his/her hand into the opening, and pick up sheets from a main body of the apparatus or access the main body to load sheets, thus resulting in a reduction in operability.

BRIEF SUMMARY

In an aspect of this disclosure, there is provided an image forming apparatus including a main body, a cover member, and a support member. The main body has a bottom face opposing a surface on which the image forming apparatus rests. The cover member is at least partially flexible, has a bottom opening, and is dimensioned to entirely cover the image forming apparatus except for the bottom face of the image forming apparatus. The support member is pivotably supported on the main body. The support member has base end portions supported on the main body and a front end portion to support a portion of the cover member. With a pivotal movement of the support member, the cover member displaces and deforms and an end of the bottom opening of the cover member moves upward to expose a portion of the image forming apparatus to be accessed by a user operating the image forming apparatus.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
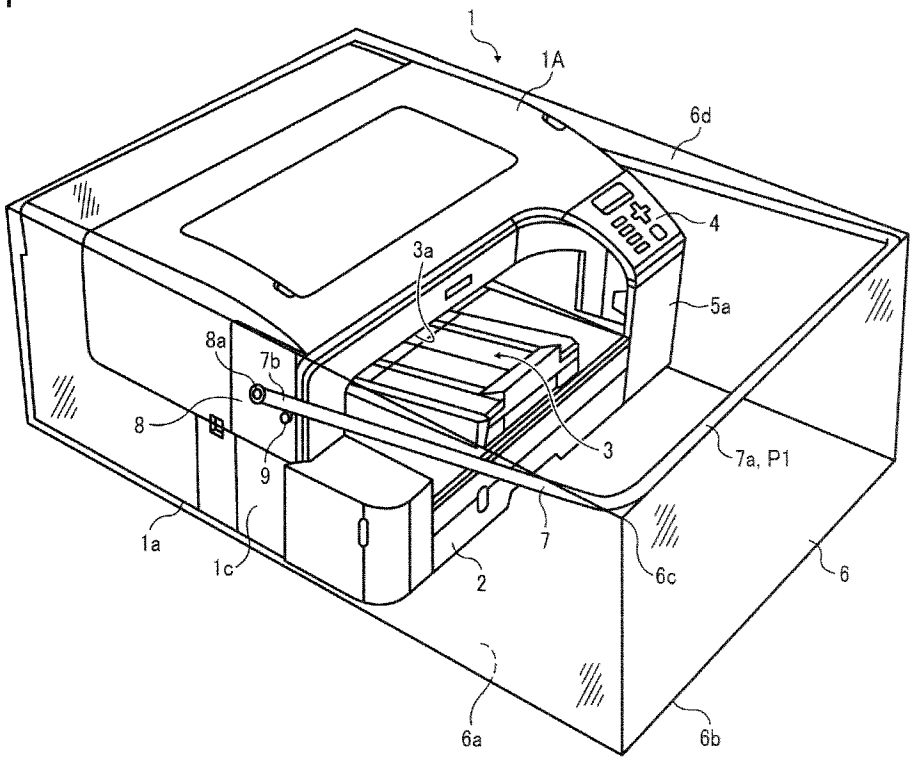
FIG. 1 is an exterior perspective view of a printer mounting a cover according to a first exemplary embodiment seen from a front side of the printer.

The accompanying drawings are intended to depict exemplary embodiments of the present disclosure and should not be interpreted to limit the scope thereof. The accompanying drawings are not to be considered as drawn to scale unless explicitly noted.

DETAILED DESCRIPTION OF EXEMPLARY EMBODIMENTS

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the exemplary embodiments are described with technical limitations with reference to the attached drawings, such description is not intended to limit the scope of the invention and all of the components or elements described in the exemplary embodiments of this disclosure are not necessarily indispensable to the present invention.

Referring now to the drawings, exemplary embodiments of the present disclosure are described below. In the following exemplary embodiments, the same reference characters are allocated to elements (members or components) having the same function and shape and redundant descriptions thereof are omitted below. Additionally, for sake of simplicity and clearness, elements considered to require no specific descriptions may be omitted from drawings.

First Exemplary Embodiment

Figure 2:
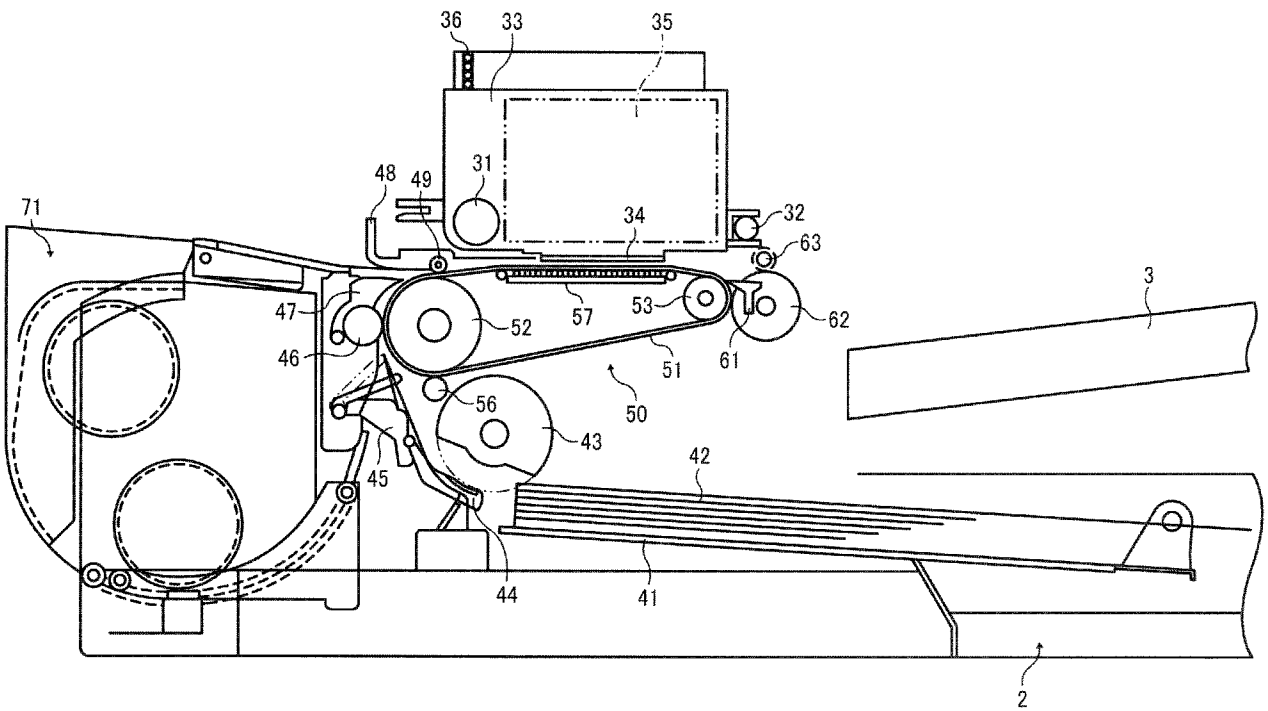
FIG. 2 is a side view of an entire configuration of a mechanical section of the printer.
Figure 3:
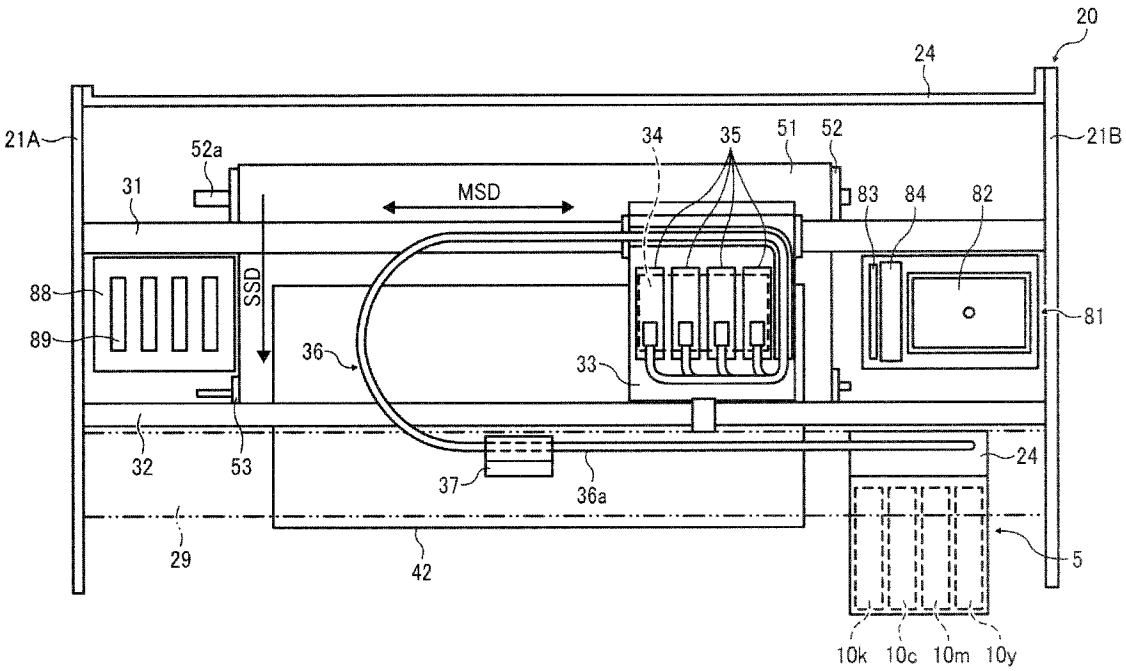
FIG. 3 is a plan view of a portion of the mechanical section of FIG. 2.

With reference to FIGS. 1 to 3, first, an entire configuration and operation of a printer serving as an inkjet recording apparatus which is an example of an image forming apparatus according to a first exemplary embodiment of this disclosure.

FIG. 1 is an exterior perspective view of the printer with a cover mounted thereon seen from the front side of the printer. FIG. 2 is a side view of an entire configuration of a mechanical section of the printer. FIG. 3 is a plan view of a portion of the mechanical section of FIG. 2. The front side of the printer is located at the right side in FIG. 2 and the lower side in FIG. 3.

The inkjet recording apparatus illustrated in FIGS. 1 to 3 is a printer serving as a serial-type inkjet recording apparatus. In FIGS. 1 to 3, the printer 1 has a main body 1A, a sheet feed tray 2, and the sheet output tray 3. The main body 1A includes a frame 20 forming a skeleton of the printer 1 and exterior panels forming a housing of the printer 1. The sheet feed tray 2 is mounted in the main body 1A and serves as a sheet accommodation unit to accommodate sheets. The sheet output tray 3 is removably mounted in the main body 1A and serves as a sheet stack unit on which sheets having images recorded/formed are stacked. Each of the sheet feed tray 2 and the sheet output tray 3 is partially exposed to the outside of the main body 1A. As illustrated in FIGS. 1 and 2, above the sheet output tray 3 is formed a sheet output opening 3*a* serving as a space through which sheets having images formed thereon are discharged.

At one end portion of the front side of the main body 1A (near a lateral side of the sheet output tray 3) is disposed a cartridge mounting portion 5 (see FIG. 3) having a front cover 5*a* to open and close cartridge mounting ports into which liquid cartridges are mounted/inserted. The cartridge mounting portion 5 protrudes forward from the front side of the main body 1A and is disposed at a position lower than an upper face of the main body 1A. At an upper face of the cartridge mounting portion 5 is disposed a control panel 4 serving as an operation-and-display unit having operation buttons and a display. As illustrated in FIG. 1, the printer 1 also has a cover 6, a support member 7, and attachment members 8.

As illustrated in FIG. 3, liquid cartridges 10*k*, 10*c*, 10*m*, and 10*y* (hereinafter referred to as "liquid cartridges 10" unless colors distinguished) serving as multiple liquid containers to separately contain different color inks of, e.g., black (K), cyan (C), magenta (M), and yellow (Y) are mountable at the front side of the cartridge mounting portion 5. The liquid cartridges 10 are inserted from the front side of the main body 1A toward the rear side of the main body 1A to be mounted in the cartridge mounting portion 5. The liquid cartridges 10*k*, 10*c*, 10*m*, and 10*y* are arranged upright side by side.

The control panel 4 includes remaining-quantity indicators indicating that the remaining quantities of the respective color liquids in the liquid cartridges 10*k*, 10*c*, 10*m*, and 10*y* are at near-end state or end state. In the control panel 4, the remaining-quantity indicators are disposed at positions corresponding to the mount positions of the liquid cartridges 10*k*, 10*c*, 10*m*, and 10*y*. Additionally, for example, a power button, a sheet-feed/print-restart button, and a cancel button are disposed in the control panel 4.

As described above, the printer 1 has a front operation design to enable a user to pick up a sheet having an image formed thereon from the sheet output tray 3, operate buttons of the control panel 4, and handle the cartridge mounting portion 5 with the user opposing the front face of the main body 1A illustrated in FIG. 1. In using the printer 1 as the image forming apparatus, the user accesses, for example, the sheet feed tray 2, the sheet output tray 3, the control panel 4, and the cartridge mounting portion 5.

As illustrated in FIG. 3, the main body 1A has two, left and right, main side plates 21A and 21B and a rear plate 24 forming the frame 20. As illustrated in FIG. 3, a main guide rod 31 and a sub guide rod 32 serving as guide members extend between the main side plates 21A and 21B. The main guide rod 31 and the sub guide rod 32 support the carriage 33 so that the carriage 33 is slidable in a main scanning direction indicated by a double arrow MSD in FIG. 3. The carriage 33 is reciprocally moved for scanning in the main scanning direction MSD by a main scanning motor via a timing belt.

On the carriage 33 are mounted recording heads (droplet ejection heads) 34 having multiple nozzle rows to eject droplets of the different color liquids of black (K), cyan (C), magenta (M), and yellow (Y).

On the carriage 33 is mounted a plurality of liquid tanks 35 to supply the different color liquids to the respective recording heads 34. The different color inks are replenished from the respective liquid cartridges 10 mounted in the cartridge mounting portion 5 to the liquid tanks 35 via flexible supply tubes 36 dedicated for the respective colors. In the cartridge mount portion 5 is mounted a supply-pump unit to feed liquids from the liquid cartridges 10. A holding member 37 holds the supply tubes 36 on a stay 29 indicated by a broken line in FIG. 3.

As illustrated in FIG. 2, the printer 1 further includes a sheet feed section to feed sheets 42 stacked on a sheet stack portion (platen) 41 of the sheet feed tray 2. The sheet feed section includes a sheet feed roller 43 and a separation pad 44. The sheet feed roller 43 of, e.g., a half moon shape separates the sheets 42 from the sheet stack portion 41 and feeds the sheets 42 sheet by sheet. The separation pad 44 is disposed facing the sheet feed roller 43, is made of a material of a high friction coefficient, and is urged toward the sheet feed roller 43. To feed the sheet 42 from the sheet feed section to a position below the recording heads 43, the printer 1 has a first guide member 45 to guide the sheet 42, a counter roller 46, a conveyance guide member 47, a press member 48 including a front-end press roller 49, and a conveyance belt 51 serving as a conveyance unit to convey the sheet 42 to a position opposing the recording heads 34 with the sheet 42 electrostatically adhered on the conveyance belt 51.

The conveyance belt 51 is an endless belt looped around a conveyance roller 52 and a tension roller 53 so as to circulate in a belt conveyance direction (sub-scanning direction).

The printer 1 also has a charging roller 56 serving as a charging unit to charge an outer surface of the conveyance belt 51. The charging roller 56 is disposed so as to contact the outer surface of the conveyance belt 51 and rotate with the circulation of the conveyance belt 51. On the reverse (inner) side of the conveyance belt 51, a second guide member 57 serving as a platen unit is disposed at a position corresponding to a printing (recording) area of the recording heads 34. The conveyance roller 52 is rotated by a sub-scanning motor via a timing roller, so that the conveyance belt 51 circulates in the belt conveyance direction, that is, the sub-scanning direction indicated by an arrow SSD in FIG. 3.

As illustrated in FIG. 2, a duplex unit 71 is mounted on a rear portion of the main body 1A. When the conveyance belt 51 rotates in reverse to return the sheet 42, the duplex unit 71 receives the sheet 42. Then the duplex unit 71 turns the sheet 42 around to feed the sheet 42 again to a position between the counter roller 46 and the conveyance belt 51.

As illustrated in FIG. 3, the image forming apparatus further includes a sheet output section to output the sheet 42 having an image formed by the recording heads 43. The sheet output section includes a separation claw 61 to separate the sheet 42 from the conveyance belt 51, a first output roller 62, a second output roller 63, and the sheet output tray 3 disposed below the first output roller 62.

As illustrated in FIG. 3, a maintenance unit 81 is disposed at a non-printing (non-recording) area that is located at one end in the main-scanning direction of the carriage 33. The maintenance unit 81 maintains and recovers nozzle conditions of the recording heads 34. The maintenance unit 81 includes caps 82 to collectively cover the nozzles of the recording heads 34, a wiper blade 83 serving as a blade member to wipe the nozzle faces of the recording heads 34, and a first droplet receptacle 84 to receive liquid droplets discharged during maintenance ejection in which liquid droplets not contributing to a recorded image are discharged to remove increased-viscosity recording liquid from the nozzles of the recording heads.

Waste recording liquid discharged in such maintenance-and-recovery operation of the maintenance unit 81, liquid discharged to the caps 82, liquid adhered to the wiper blade 83 and wiped with a wiper cleaner, and liquid (ink) discharged to the first droplet receptacle 84 are accommodated in a waste tank.

As illustrated in FIG. 3, a second droplet receptacle 88 is disposed at a non-printing area on the other end in the main-scanning direction of the carriage 33. The second droplet receptacle 88 receives liquid droplets that are discharged to remove increased-viscosity recording liquid during, e.g., recording (image forming) operation. The second droplet receptacle 88 has openings 89 arranged in parallel with the rows of nozzles of the recording heads 134.

Next, operation of the printer having the above-described configuration is described with reference to FIGS. 2 and 3.

First, the sheet feed roller 43 and the separation pad 44 cooperate to separate and feed the sheets 42 sheet by sheet from the sheet feed tray 2. The sheet 42 is fed upward in a substantially vertical direction, guided along the first guide member 45, and conveyed between the conveyance belt 51 and the counter roller 46. Further, the front edge of the sheet 42 is guided along the conveyance guide member 47 and pressed against the conveyance belt 51 by the front-end press roller 49 to turn the transport direction of the sheet 42 by substantially 90 degrees.

At this time, the conveyance roller 52 is rotated by the sub-scanning motor, so that the conveyance belt 51 circulates in the sub-scanning direction (belt conveyance direction) indicated by the arrow SSD in FIG. 3. Meanwhile, an AC (alternating current) bias supply unit of a controller alternately supplies positive and negative voltages to the charging roller 56 so that the conveyance belt 51 is charged with an alternating voltage pattern, that is, an alternating band pattern of positively-charged band areas and negatively-charged band areas.

When the sheet 42 is fed onto the conveyance belt 51 alternately charged with positive and negative charges, the sheet 42 is adhered onto the conveyance belt 51 and conveyed in the sub-scanning direction with the circulation of the conveyance belt 51. By driving the recording heads 34 in response to image signals while moving the carriage 33, liquid (ink) droplets are ejected on the sheet 42 stopped below the recording heads 43 to form one line of a desired image. After the sheet 42 is fed by a certain amount, another line of the image is recorded on the sheet 42.

Then, the sheet 42 is conveyed by the conveyance belt 51 with the rotation of the conveyance roller 52. The sheet 42 having the image formed thereon is separated from the conveyance belt 51 with the separation claw 61 which is pivotably disposed between the tension roller 53 and the conveyance roller 52. The second output roller 63 is rotated with the rotation of the first output roller 62 to feed the sheet 42. Receiving a signal indicating that the image has been recorded or that the rear edge of the sheet 42 has arrived at the printing (recording) area, the recording heads 43 finish the recording operation and the sheet 42 is outputted to the sheet output tray 3.

In waiting for the next recording (printing) operation, the carriage 33 is shifted to a position above the maintenance unit 81 and the nozzle faces of the recording heads 34 are sealed with the caps 82. Thus, the moisture in the nozzles is kept to prevent an ejection failure due to ink drying. With the nozzle faces of the recording heads 34 sealed with the caps 82, a suction pump suctions recording liquid from the nozzles to remove increased-viscosity liquid (ink or other recording liquid) or air bubbles. Thus, recovery operation is performed. Further, before or during a recording operation, the above-described maintenance ejection is performed in which ink not contributing to a recorded image is discharged for maintenance. Such maintenance ejection allows stable ejection performance of the recording heads 34. Descriptions of operation of the printer 1 during duplex printing with the duplex unit 71 are omitted for simplicity.

Next, the cover 6, the support member 7, and the attachment member 8 are described with reference to FIGS. 1 to 4.

Figure 4:
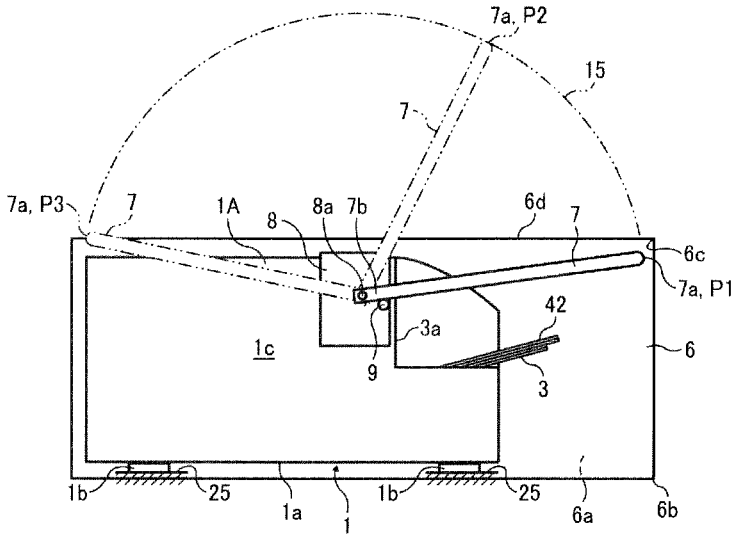
FIG. 4 is a side view of the cover and the printer illustrating operation of the cover and a support member in the first exemplary embodiment.

In FIG. 1, no sheets having images formed thereon are discharged or stacked on the sheet output tray 3. FIG. 4 is a side view of the printer 1 illustrated to describe operation of the cover 6 and the support member 7 in the first exemplary embodiment.

The cover 6 is a sheet-type flexible cover member serving as a dustproof cover mounted on the printer 1 to prevent dirt or dust from adhering to or accumulating on the printer 1. The same applies to a cover 6A according to another exemplary embodiment illustrated in FIGS. 6 and 7. Typically, the printer 1 rests on a surface 25, such as a table or floor surface, via mounting portions 1*b* disposed on a bottom surface la so as to protrude downward from the bottom surface 1*a*.

The cover 6 has a substantially rectangular parallelepiped shape to entirely cover the printer 1 except for the bottom surface 1*a*, in which a bottom opening 6*a* is opened opposing the bottom surface 1*a*. The shape of the cover 6 is maintained by the main body 1A and the support member 7. Such a configuration allows a user to mount and remove the cover 6 onto and from the printer 1 by simple operation. In other words, the user can mount the cover 6 onto the printer 1 by simply putting the cover 6 onto an upper portion of the printer 1 through the bottom opening 6*a* of the cover 6, and remove or detach the cover 6 from the printer 1 by simply picking up an upper portion 6*d* of the cover 6 by his/her hand.

The cover 6 is preferably made of flexible material, for example, polyvinyl chloride (PVC) or other plastic, to displace or deform in response to movement of the support member 7. At least a portion or the entire of the cover 6 may be made of light-transmissive, transparent or semi-transparent material to enable a user to see the inside of the cover 6 and easily operate the printer 1. For example, at at least an area corresponding to parts which a user need access from the outside of the cover 1 to use the printer 1, the cover 6 preferably has a transparent portion(s) allowing the user to see the parts, such as, the sheet feed tray 2, the sheet output tray 3, the control panel 4, and the cartridge mounting portion 5.

The cover 6 of the substantially rectangular parallelepiped shape protrudes corresponding to the sheet output tray 3 extending forward from the front side of the main body 1A so as to have a relatively large space at a side close to the sheet output tray 3. The cover 6 has an upper corner portion 6*c* of a substantially right angle shape engageable with a front end portion 7*a* of the support member 7.

The support member 7 is made of, for example, resin or metal material having a cylindrical shape in cross section. The support member 7 protrudes forward of the main body 1A correspondingly to the shape of the cover 6 to obtain a space in which the sheet 42 having an image formed thereon is discharged from the sheet output opening 3*a* to the sheet output tray 3 at the front face of the main body 1A. The support member 7 also has a substantially U-shape on a plan view and substantially the same width as a width of the main body 1A to support the cover 6 of the substantially rectangular parallelepiped shape covering the printer 1 by a single component, that is, the support member 7. In this exemplary embodiment, base end portions 7*b* of lateral sides of the substantially U-shaped support member 7 are pivotably supported at respective side faces 1*c* of the main body 1A via attachment members 8. The front end portion 7*a* of the support member 7 pivotably supports the upper corner portion 6*c* of the cover 6.

The base end portions 7*b* of the lateral sides of the support member 7 are supported by shafts 8*a* of the attachment members 8 fixed at the printer 1 so as to be pivotable around the shafts 8*a*. As a result, as illustrated in FIG. 4, the front end portion 7*a* of the support member 7 is pivotable on an arc-shaped movement trajectory 15 around the respective shafts 8*a*. The positions of supported points of the base end portions 7*b* of the support member 7 are not limited to the positions illustrated in FIG. 4 but may be any other positions/places. However, preferably, as illustrated in FIG. 4, the positions of supported points of the base end portions 7*b* are placed higher than the sheet output opening 3*a*.

When the support member 7 is placed at an initial position P1 illustrated in FIG. 1, the base end portions 7*b* contact stopper members 9 protruding outward from the respective attachment members 8, thus preventing the support member 7 from pivoting to a position lower than the initial position P1.

The attachment members 8 may be fixed relative to the main body 1A of the printer 1 with, for example, double-faced adhesive tapes. Alternatively, the attachment members 8 may be fixed with, for example, screws or fitting dips so as to be removably mountable relative to the main body 1A. It is to be noted that the attachment members 8 may be not necessary and, for example, the base end portions 7*b* of the support member 7 may be directly supported by the main body 1A in a pivotable manner. In other words, any other member or mechanism other than those described above can be used to pivot the support member 7 relative to the main body 1A.

By pivoting the front end portion 7*a* of the support member 7 counterclockwise from the initial position P1 illustrated in FIGS. 1 and 4 around the shafts 8*a*, the upper corner portion 6*c* of the cover 6 engaging the front end portion 7*a* is lifted up along the arc-shaped movement trajectory 15 while the cover 6 displaces and deforms. As a result, an end (hereinafter "bottom opening end 6*b*") of the bottom opening 6*a* at a front side of the cover 6 (front right side in FIG. 1) is lifted up to a position to open the parts, such as the sheet output tray 3 and the sheet output opening 3*a*, to which a user need access in using the printer 1, thus allowing the user's accessing parts at the front face of the printer 1 (e.g., the sheet feed tray 2, the sheet output tray 3, the sheet output opening 3*a*, the control panel 4, and the cartridge mounting portion 5) to be widely opened to the outside of the cover 6. Such a configuration allows the user to operate and check the printer 1, replenish or replace consumables, such as sheets and ink, and pick up output sheets without removing the cover 6.

The configuration and operation are further described below with reference to FIG. 4.

With the support member 7 placed at the initial position P1, a user can hold the front end portion 7*a* of the support member 7 by his/her hand via the upper corner portion 6*c* of the cover 6. In picking up the sheet 42 from the sheet output tray 3, the user holds the front end portion 7*a* of the support member 7 at the initial position P1 via the upper corner portion 6*c* of the cover 6 by one hand and lifts the support member 7 to a first open position P2 (hereinafter, simply "open position P2") indicated by a broken line in FIG. 4 so that the support member 7 pivots counterclockwise around the shafts 8*a* along the arc-shaped movement trajectory 15. At this time, while the cover 6 displaces and deforms, the bottom opening end 6*b* of the front side of the cover 6 is lifted to a position upper than the sheets 42 stacked on the sheet output tray 3, thus allowing the user to pick up the sheets 42 by the other hand.

When the user releases the hand from the front end portion 7*a* at the open position P2, the support member 7 returns to the initial position P1 clockwise along the arc-shaped movement trajectory 15 by its weight, thus allowing simple operation. In checking the printer 1 or replenishing or replacing consumables, such as sheets and ink, the user holds the front end portion 7*a* of the support member 7 via the upper corner portion 6*c* of the cover 6 and further pivots the front end portion 7*a* from the open position P2 to a second open position P3 (hereinafter, simply "open position P3") indicated by another broken line in FIG. 4. At this time, while the cover 6 further displaces and deforms, the front end portion 7*a* of the support member 7 contacts the upper face of the main body 1A. As a result, the front face and substantially half of the upper face of the main body 1A are largely opened to the outside, thus facilitating the user's operation.

As described above, this exemplary embodiment obviates a special opening, except for the bottom opening 6*a* generally used to mount and remove the cover 6 to and from the printer 1 serving as the image forming apparatus, and an opening-and-closing unit for opening and closing such a special opening. This exemplary embodiment can also provide the dustproof cover 6 facilitating user's access to parts of the printer 1, such as the sheet feed tray 2, the sheet output tray 3, the control panel 4, and the cartridge mounting portion 5, and the printer 1 having the dustproof cover 6. The cover 6 is made of flexible and elastic material, thus allowing a reduced size of the entire cover 6. At least a portion of the cover 6 corresponding to the parts of the printer 1, such as the sheet feed tray 2, the sheet output tray 3, the control panel 4, and the cartridge mounting portion 5, which a user need access in operating the printer 1 is made of light-transmittable material, thus allowing the user to see the inside of the cover 6.

Second Exemplary Embodiment

A second exemplary embodiment of this disclosure is described with reference to FIG. 5.

Figure 5:
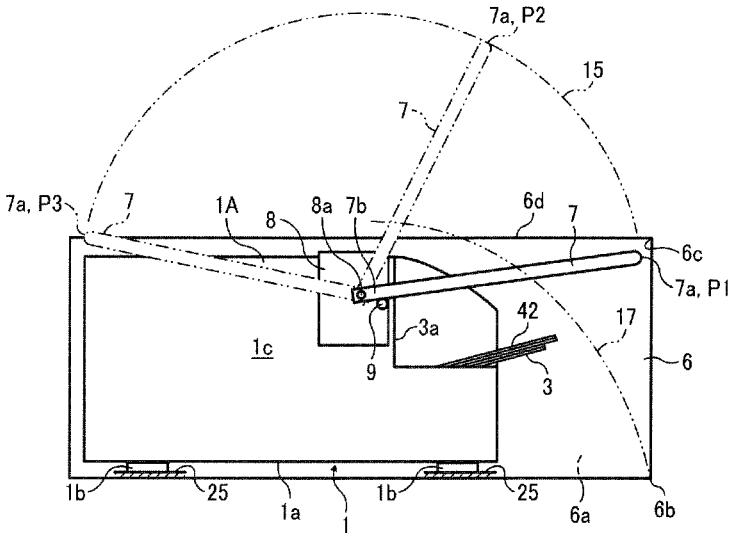
FIG. 5 is a side view of a cover and a printer according to a second exemplary embodiment illustrating operation of the cover and a support member.

FIG. 5 is a side view of a cover 6 and a printer 1 according to the second exemplary embodiment illustrating operation of the cover 6 and a support member 7 in the second exemplary embodiment.

The second exemplary embodiment differs from the first exemplary embodiment of FIGS. 1 to 4 in that the cover 6 of the second exemplary embodiment has such a size that, when the support member 7 pivots, a bottom opening end 6*b* at a front side of the cover 6 does not contact sheets 42 stacked on the sheet output tray 3. Except for the difference, the configuration of the second exemplary embodiment is substantially the same as the configuration of the first exemplary embodiment illustrated in FIGS. 1 to 4.

In FIG. 5, a broken line 17 indicates a trajectory of movement of the bottom opening end 6*b* at the front side of the cover 6 drawn when the support member 7 pivots. In this exemplary embodiment, the length of the support member 7 from the base end portions 7*b* to the front end portion 7*a* is set to such a length that the sheets 42 discharged and stacked on the sheet output tray 3 do not intersect the movement trajectory 17 of the bottom opening end 6*b*. In other words, by specifying the movement trajectory 17 of the bottom opening end 6*b*, this exemplary embodiment clearly defines that the support member 7 has such a length that, while the support member 7 pivots, the sheet 42 discharged and stacked on the sheet output tray 3 do not contact the movement trajectory 17 of the bottom opening end 6*b*.

Accordingly, besides advantages and effects equivalent to those of the first exemplary embodiment, this second exemplary embodiment also allows a user to securely pick up the sheet 42 from the sheet output tray 3 without being hampered by the cover 6 because, even when the user lifts up the front end portion 7*a* of the support member 7 to the open position P2 to pick up the sheet 42 on the sheet output tray 3, the bottom opening end 6*b* of the cover 6 does not contact the sheets 42 stacked on the sheet output tray 3. Such a configuration facilitates the user to pick up the sheets 42 from the sheet output tray 3.

Third Exemplary Embodiment

A third exemplary embodiment of this disclosure is described with reference to FIGS. 6 and 7.

Figure 6:
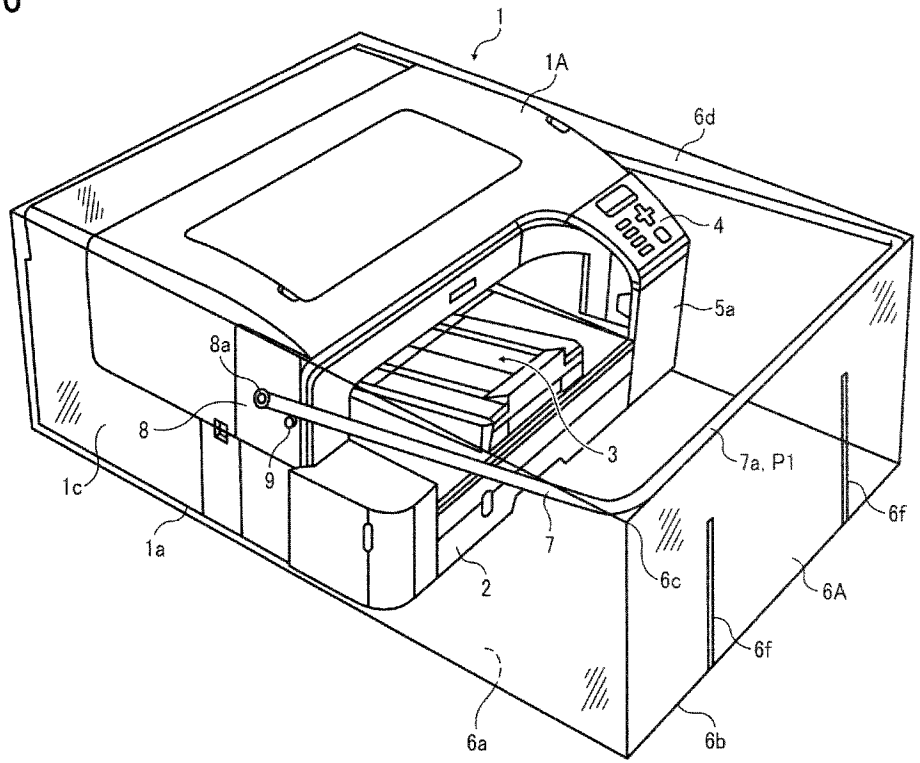
FIG. 6 is an exterior perspective view of a printer mounting a cover according to a third exemplary embodiment seen from a front side of the printer.
Figure 7:
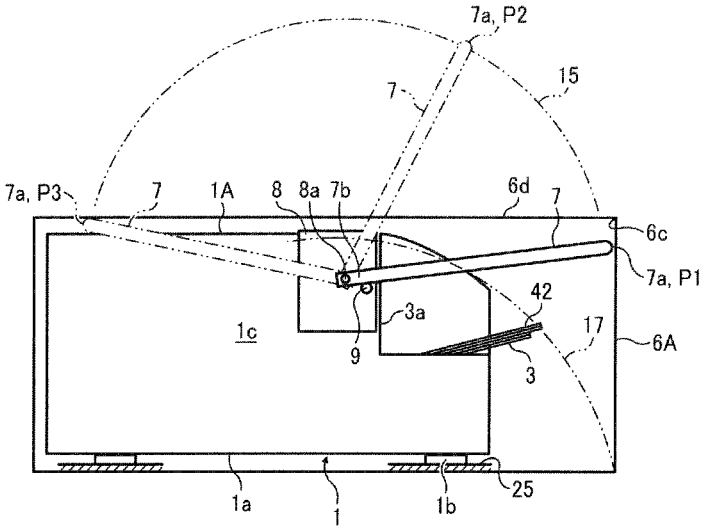
FIG. 7 is a side view of the printer of FIG. 6 illustrating operation of the cover and a support member.

FIG. 6 is an exterior perspective view of a printer 1 with a cover 6A mounted thereon according to the third exemplary embodiment seen from the front side of the printer 1. FIG. 7 is a side view of the cover 6A and the printer 1 illustrating operation of the cover 6A and a support member 7A in the third exemplary embodiment.

The third exemplary embodiment differs from the second exemplary embodiment illustrated in FIG. 5 in that the cover 6A is used in the third exemplary embodiment instead of the cover 6 of the second exemplary embodiment. Except for the difference, the configuration of the third exemplary embodiment is substantially the same as the configuration of the second exemplary embodiment illustrated in FIG. 5.

The cover 6A differs from the cover 6 in that the cover 6A has two slits 6*f* opposing the sheet output tray 3 and extending upward from a bottom opening end 6*b*. The slits 6*f* are also arranged to have an interval of substantially the same size to the size of the sheet 42 in the width direction (more specifically, the maximum size in the width direction of the sheet usable in the printer 1).

In the second exemplary embodiment of FIG. 5, the support member 7 has a relatively long length such that the movement trajectory 17 of the bottom opening end 6*b* at the front side of the cover 6 does not contact the sheets 42 on the sheet output tray 3. By contrast, as in this third exemplary embodiment, even in a case in which the sheets 42 on the sheet output tray 3 intersect a movement trajectory 17 of the bottom opening end 6*b* at the front side of the cover 6A, the above-described two slits 6*f* limit deformation of the cover 6A, caused by contact with the sheets 42 on the sheet output tray 3, to an area between the slits 6*f*, thus preventing the cover 6A from hampering the pivotal movement of the support member 7A.

Accordingly, besides advantages and effects equivalent to those of the second exemplary embodiment, this third exemplary embodiment can employ a shorter length of the support member 7 than that of the second exemplary embodiment, thus allowing a reduction in the entire size of the cover 6A as compared to the cover 6 of the second exemplary embodiment.

Fourth Exemplary Embodiment

A fourth exemplary embodiment of this disclosure is described with reference to FIG. 8.

Figure 8A:
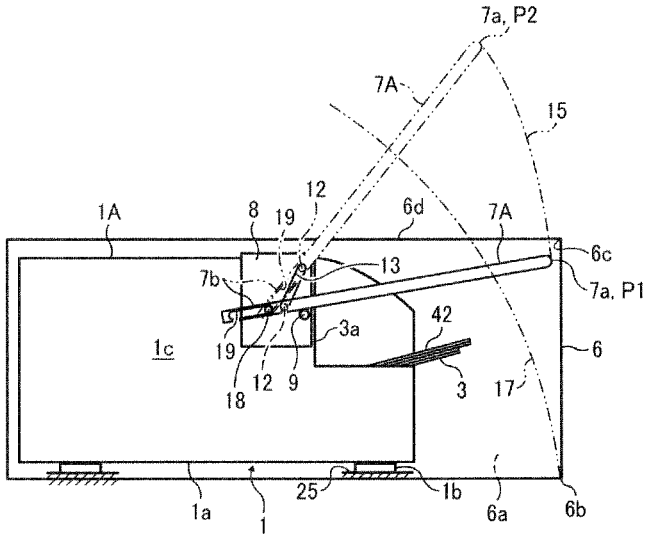
FIG. 8A is a side view of a cover and a printer according to a fourth exemplary embodiment illustrating operation of the cover and a support member.
Figure 8B:
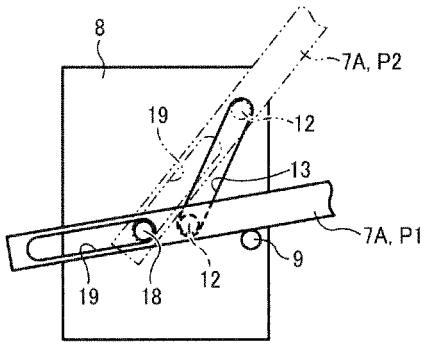
FIG. 8B is an enlarged view of a sliding mechanism illustrated in FIG. 8A.

FIG. 8A is a side view of a cover 6 and a printer 1 according to the fourth exemplary embodiment illustrating operation of the cover 6 and a support member 7A in the fourth exemplary embodiment. FIG. 8B is an enlarged view of a sliding mechanism of FIG. 8A.

The fourth exemplary embodiment differs from the second exemplary embodiment illustrated in FIG. 5 in that, in the fourth exemplary embodiment, a support member 7A is employed instead of the support member 7 of the second exemplary embodiment and that a sliding mechanism is employed as a support unit to support base end portions 7*b* of the support member 7A. Except for the difference, the configuration of the fourth exemplary embodiment is substantially the same as the configuration of the second exemplary embodiment illustrated in FIG. 5.

The support member 7A differs from the support member 7 of FIG. 5 in that each of the base end portions 7*b* has a slot 19 formed along a longitudinal direction of the support member 7A and that each of the base end portions 7*b* has a pin 12 protruding from an inner side of the support member 7A (a back side in FIGS. 8A and 8B) inward relative to a side face 1*c* of the printer 1. Additionally, attachment members 8 in the fourth exemplary embodiment differ from those of the above-described exemplary embodiments in that, instead of the shaft 8*a*, each of attachment members 8 in the fourth exemplary embodiment has a pin 18 protruding outward relative to the side face 1*c* of the printer 1 to loosely fit into the slot 19 to slidingly guide the support member 7A in the longitudinal direction of the support member 7A and a slot 13 loosely fitting with the pin 12 to guide the pin 12 with the movement of the support member 7A between the initial position P1 and the open position P2 (in other words, the slot 13 is formed along a direction in which the pin 12 moves when the support member 7A moves between an initial position P1 and an open position P2).

Operation in this fourth exemplary embodiment is described below mainly with respect to differences from the second exemplary embodiment.

With the support member 7A placed at the initial position P1, a user can hold a front end portion 7*a* of the support member 7A by his/her hand via the upper corner portion 6*c* of the cover 6. To pickup the sheets 42 from the sheet output tray 3, the user holds the front end portion 7*a* of the support member 7A placed at the initial position P1 via the upper corner portion 6*c* of the cover 6 by one hand (at this time, the immovable pin 18 is fitted into the slot 19 in contact with the right end of the slot 19 in FIG. 8B and the movable pin 12 is fitted into the slot 13 in contact with the lower end of the slot 13 in FIG. 8B). When the user lifts up while pivoting the support member 7A counterclockwise via the pins 12 and 18, the movable slot 19 slides upward while being guided by the immovable pin 18. At the same time, the movable pin 12 slides with the support member 7A while being guided by the immovable slot 13. Thus, quasi-pivotal movement of the support member 7A is regulated by the above-described operation of the sliding mechanism.

With the quasi-pivotal movement of the support member 7A, the length from the base end portion 7*b* supported by the second pin 18 to the front end portion 7*a* of the support member 7A gradually increases. Meanwhile, the front end portion 7*a* of the support member 7A is lifted up to the open position P2, indicated by a broken line in FIG. 8A, while drawing a movement trajectory 15 gradually approaching a straight line. At the same time, the cover 6 displaces and deforms, and the bottom opening end 6*b* at the front side of the cover 6, while drawing a movement trajectory 17 gradually approaching a straight line, is lifted to a position higher than a level of the sheets 42 stacked on the sheet output tray 3, thus allowing the user to pick up the sheet 42 by the other hand.

In this exemplary embodiment, the sliding mechanism serving as the support unit supports the support member 7A by the combination of two pairs of pins 12, 18 and slots 13, 19. Such a configuration using the sliding mechanism causes the movement trajectory 15 of the front end portion 7*a* of the support member 7A to more approach a straight line than the configuration in which the support member 7 is pivotably supported by the shafts 8*a* as in the second exemplary embodiment. As a result, in this exemplary embodiment, the movement trajectory 17 of the bottom opening end 6*b* at the front side of the cover 6 also more approaches a straight line. Accordingly, at the initial position P1, the length of the support member 7A protruding forward from the front side of the printer 1 can be shorter than that of the support member 7 illustrated in FIG. 5. Thus, besides advantages and effects equivalent to those of the second exemplary embodiment, this exemplary embodiment allows a reduction in the entire size of the cover 6.

In this exemplary embodiment, the above-described sliding mechanism (including the pins 12, 18 and the slots 13, 19) is employed as the support unit to support the base end portions 7*b* of the support member 7A. However, it is to be noted that the support unit is not limited to the sliding mechanism but may be any other suitable mechanism if the movement trajectory 15 of the front end portions of the support member more approaches a straight line than that of any of the above-described first to third exemplary embodiments.

In the first to fourth exemplary embodiments, at the initial position P1, the front end portion 7*a* of the support member 7 or 7A engages the upper corner portion 6*c* of the cover 6 or 6A. However, it is to be noted that the state of the front end portion 7*a* at the initial position P1 is not limited to such a state. For example, if enhancement of the operability achieved by extending the range of the movement trajectory of the front end portion 7*a* is not so highly prioritized, the initial position P1 may be set to a position at which the front end portion 7*a* engages the bottom opening ends 6*b* of the front side of the cover 6 or 6A.

Numerous additional modifications and variations are possible in light of the above teachings. It is therefore to be understood that, within the scope of the appended claims, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

For example, an image forming apparatus recited in appended claims is not limited to the above-described printer serving as an inkjet-type image forming apparatus but may be, for example, other type of printer, a thermal or other type of information recording apparatus, a copier, a facsimile machine, a plotter, a word processor, a printing press, or a multi-functional device having two or more of the foregoing capabilities. Additionally, sheets are not limited to the sheets of paper but may be, for example, any other type of sheets, recording media, or recorded media on which images can be formed or recorded according to an inkjet, electrophotographic, thermal, or other recording method.

What is claimed is:

1. An image forming apparatus comprising:

a main body having a bottom face, the bottom face opposing a surface on which the image forming apparatus rests;

a cover member being flexible, having a bottom opening, and dimensioned and having a cover position shape to cover the entire main body except for the bottom face of the image forming apparatus; and a support member pivotably supported on the main body, the support member having base end portions supported on the main body, and a front end portion to support a portion of the cover member, wherein a pivotal movement of the support member pivotably supported on the main body causes the flexible cover member to displace and deform the cover member from the cover position shape to a retracted position shape that is different than the cover position shape, and a bottom end portion of a front side of the cover member moves upward to expose a portion of the image forming apparatus to be accessed by a user operating the image forming apparatus.

2. The image forming apparatus according to claim 1, wherein at least a portion of the cover member corresponding to the portion of the image forming apparatus to be accessed by the user is made of light-transmissive material.

3. The image forming apparatus according to claim 1, further comprising a sheet stack unit disposed at one exterior side of the main body to stack sheets discharged after image formation, wherein the support member has such a length that, during the pivotal movement of the support member, the sheets stacked on the sheet stack unit do not intersect a movement trajectory of the end of the bottom opening of the cover member.

4. The image forming apparatus according to claim 1, further comprising a sheet stack unit disposed at one exterior side of the main body to stack sheets discharged after image formation;

wherein the cover member has two slits opposing the sheet stack unit, the slits extending upward from the bottom end portion of the front side of the cover member and having an interval therebetween of a substantially same size as a width of the sheets.

5. The image forming apparatus according to claim 1, wherein the base end portions of the support member are pivotably supported at side faces of the main body.

6. The image forming apparatus according to claim 1, further comprising a sliding mechanism slidably supporting the base end portions of the support member relative to the main body.

7. The image forming apparatus according to claim 1, wherein the support member is substantially U-shaped.

8. An image forming apparatus comprising:

a main body having a bottom face, the bottom face opposing a surface on which the image forming apparatus rests;

a cover member being flexible, having a bottom opening, and dimensioned to cover the entire main body except for the bottom face of the apparatus; and a substantially U-shaped support member pivotably supported on the main body, the support member having base end portions supported on the main body, and a front end portion to support a portion of the cover member, wherein the support member is a single component element, wherein the base end portions of the support member are pivotably supported at side faces of the main body, and wherein, with a pivotal movement of the support member, the cover member displaces and deforms and a bottom end portion of a front side of the cover member moves upward to expose a portion of the image forming apparatus to be accessed by a user operating the image forming apparatus.

* * * * *